US011008745B2

(12) United States Patent
Bruno

(10) Patent No.: US 11,008,745 B2
(45) Date of Patent: May 18, 2021

(54) AUTOMATED TOILET CLEANING ASSEMBLY AND SHOWER ASSEMBLY

(71) Applicant: Jocelyn Bruno, Converse, TX (US)

(72) Inventor: Jocelyn Bruno, Converse, TX (US)

( * ) Notice: Subject to any disclaimer, the term of this patent is extended or adjusted under 35 U.S.C. 154(b) by 0 days.

(21) Appl. No.: 16/383,580

(22) Filed: Apr. 13, 2019

(65) Prior Publication Data

US 2020/0063423 A1 Feb. 27, 2020

Related U.S. Application Data

(60) Provisional application No. 62/765,206, filed on Aug. 20, 2018.

(51) Int. Cl.
*E03D 9/00* (2006.01)

(52) U.S. Cl.
CPC ..... *E03D 9/002* (2013.01)

(58) Field of Classification Search
CPC ..... E03D 9/002
USPC ..... 4/662–665
See application file for complete search history.

(56) References Cited

U.S. PATENT DOCUMENTS 2,076,950 A 4/1937 Koch
2,725,575 A 12/1955 Colonna
3,381,312 A 5/1968 Whitla
3,713,176 A 1/1973 Stock
3,720,961 A 3/1973 Garvey
3,742,520 A * 7/1973 Bernardi ..... E03D 9/002 4/662
3,755,826 A * 9/1973 Roberts ..... E03D 9/002 4/662
3,869,732 A 3/1975 Gervey et al.
4,383,341 A * 5/1983 Altman ..... E03C 1/046 4/662
4,872,225 A * 10/1989 Wagner ..... E03C 1/046 4/662
4,881,284 A 11/1989 Garvey
4,944,047 A 7/1990 Gaglino
5,279,008 A 1/1994 Ritter
5,452,485 A * 9/1995 Ross ..... A47K 3/001 15/246
5,862,545 A * 1/1999 Mathis ..... A61H 33/02 4/509
5,937,448 A 8/1999 Brill et al.
(Continued)

FOREIGN PATENT DOCUMENTS

WO WO8703633 6/1987

*Primary Examiner* — Lori L Baker

(57) ABSTRACT

An automated toilet cleaning system includes at least one cleaning assembly communicatively connected to a control device. The cleaning assembly includes a positioning assembly and at least one cleaning end, wherein the positioning assembly has at least one positioning arm structured to movably dispose the cleaning end relative to the toilet. A cleaning solution chamber is included for retaining an amount of cleaning solution, and for fluidically delivering the cleaning solution chamber being to a nozzle or dispenser. When the automated toilet cleaning system is activated, the control device operates to movably position the positioning assembly to orient the cleaning end toward the toilet, and to direct a flow of water from and a flow of cleaning solution to and out of the cleaning end directed toward the toilet.

18 Claims, 12 Drawing Sheets

(56) References Cited

U.S. PATENT DOCUMENTS

| | | | | |
|---|---|---|---|---|
| 6,079,060 | A * | 6/2000 | Walker | B05B 1/14 4/601 |
| 6,550,080 | B1 * | 4/2003 | Grewal | A47K 3/281 4/601 |
| 8,185,982 | B1 * | 5/2012 | Lizama | A47K 3/28 297/180.15 |

* cited by examiner

AUTOMATED TOILET CLEANING ASSEMBLY AND SHOWER ASSEMBLY

CLAIM OF PRIORITY/CROSS-REFERENCE TO RELATED APPLICATION

The present application is based on and a claim of priority is made under 35 U.S.C. § 119(e) to provisional patent application Ser. No. 62/765,206 filed on Aug. 20, 2018, the content of which is incorporated herein in its entirety by reference.

FIELD OF THE INVENTION

The present invention is directed to an automated toilet cleaning assembly and shower assembly. The automated toilet cleaning assembly functions to automatically clean a toilet using at least one or a plurality of an automated brush, cleaning pad, water nozzle or sprayer, and cleaning solution dispensers. The shower assembly includes a dedicated hot water tank and heater for producing its own hot water. The shower will deliver water at a user-selected temperature and at a user-selected pressure.

BACKGROUND OF THE INVENTION

Many people truly dislike using public facilities, such as public restrooms, bathrooms or toilets, and often only do so out of necessity. One of the most common reasons for this dislike is due to a lack of cleanliness and the prolific spread of bacteria. For instance, many public restrooms are cleaned by a cleaning staff member who may wipe down the counters, mop, and in some cases, clean the toilets. In many settings, public bathrooms are cleaned once per day or sometimes less than once per day, particularly public restrooms in parks and other outdoor locations.

There is thus a need in the art for a system and method for automating the cleaning process in a bathroom, and particularly, the toilets. The proposed system should be easy to manufacture and easy to install in existing bathrooms or bathrooms of new construction. For example, a cleaning assembly can be mounted above the toilet which includes automated arms and/or rods to position one or more cleaning devices or apparatuses, such as a toilet brush, water or fluid distribution nozzle, cleaning pad, brush, cleaning solution dispenser, and air blower or drier in a manner to automatically scrub, clean and rinse the toilet when activated.

The proposed automated cleaning system can also be installed at home or in a private bathroom to reduce the time and effort often needed to maintain a clean and spotless toilet. The automated toilet cleaning system can be used to automatically clean virtually any toilet, whether in public or private bathrooms, and can be activated by voice command, by the push of an activation button, or it can be automatically activated on a preset schedule or after each time the toilet is used.

SUMMARY OF THE INVENTION

Accordingly, at least one embodiment of the present invention is directed to an automated cleaning system and method that can easily clean and sanitize toilets in any public or private bathroom. The automated cleaning system may, in some cases, be mounted to a support structure, such as a wall, a frame, or mounted base just above or otherwise proximate the toilet for manual or automatic activation.

In particular, the system includes one or more cleaning arm assemblies, such as, for example, a brushless cleaning arm assembly and a brush cleaning arm assembly, connected to a control device. Each of the cleaning arm assemblies include a positioning assembly and one or more cleaning devices or apparatuses, such as a brush, spray nozzle, cleaning solution dispenser, etc. The positioning assembly may include a rotational or angular driving mechanism and/or linear driving mechanisms that can move in horizontal, vertical and three-dimensional directions in order to orient the cleaning apparatuses either proximate the toilet or in the case of a brush, in contact with the toilet.

For instance, when the automated cleaning system is activated (e.g., by voice command, pressing an activation button, or automatically), the control device will operate to movably position the one or more cleaning arm assemblies via one or more positioning assemblies in order to orient the cleaning apparatus(es) toward and in some cases in contact with the toilet. A flow of water and in some cases a cleaning solution will flow to the spray nozzles and/or cleaning solution dispensers toward the toilet. The brushes can be used to scrub or brush portions of the toilet, for example, within the toilet bowl, outside the toilet bowl, etc., whereas the spray nozzles can be used to spray water and/or cleaning solution on the toilet for rinsing and washing. After the system has stopped using the brushes and the spray nozzles, in at least one embodiment, a drier can be used to blow hot or warm air onto the toilet for purposes of facilitating drying the toilet.

At the end of the cleaning cycle, the positioning assemblies can reposition the arms against the wall or frame and away from the toilet. This allows the toilet to be used again without obstruction from the cleaning system of the present invention.

Yet another embodiment of the present invention includes a shower assembly capable of maintaining and producing its own hot or temperature-controlled water. The shower assembly of at least one embodiment also includes an oversized or enlarged overhead shower head or sprayer. A user panel allows a user to select a desired temperature for the water, for example, via a rotational dial, and a water pressure, for example, via selection button. In some embodiments, the system can deliver up to four or more different water pressures.

Both the automated toilet cleaning system and the shower assembly can be easily installed in residential, commercial or public restrooms, including private homes, office buildings, airports, service stations, gas stations, hospitals, parks, etc.

These and other objects, features and advantages of the present invention will become more apparent when the drawings as well as the detailed description are taken into consideration.

BRIEF DESCRIPTION OF THE DRAWINGS

Like reference numerals refer to like parts throughout the several views of the drawings provided herein.

DETAILED DESCRIPTION OF THE INVENTION

Figure 12:
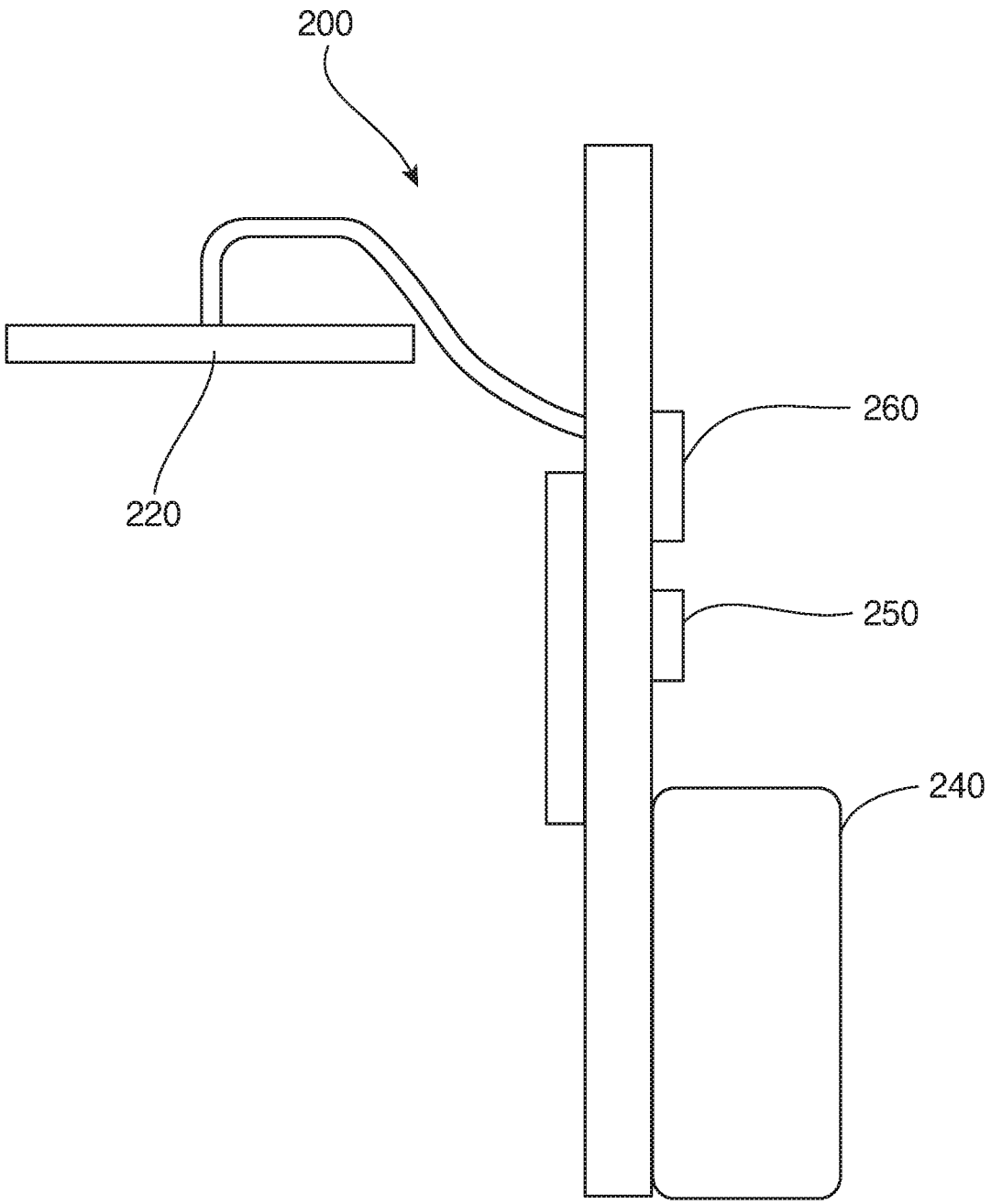
FIG. 12 is a side view of the shower assembly as disclosed in accordance with yet another embodiment of the present invention.

As shown in the accompanying drawings, and with particular reference to FIGS. 1 through 8, at least one embodiment of the present invention is directed to an automated toilet and/or bathroom cleaning system, generally referenced as 10. With reference to FIG. 12 though 15, additional or alternative embodiments of the present invention may also include a shower assembly, generally referenced as 100.

Specifically, as will become apparent from the description provided herein, the toilet or bathroom cleaning assembly or system 10 can be easily installed in any residential, commercial or industrial environments, including a private home or public restroom, for example, in airports, service stations, office buildings, hospitals, hotels, etc. Activation of the cleaning system 10 will trigger a cleaning cycle and will cause a number of cleaning devices or apparatuses, such as water nozzles, jet sprayers, cleaning solution dispensers, and brush heads, to automatically spray and/or otherwise clean the surfaces of a toilet, and in some cases, surrounding surfaces, without manual scrubbing or intervention.

Figure 1:
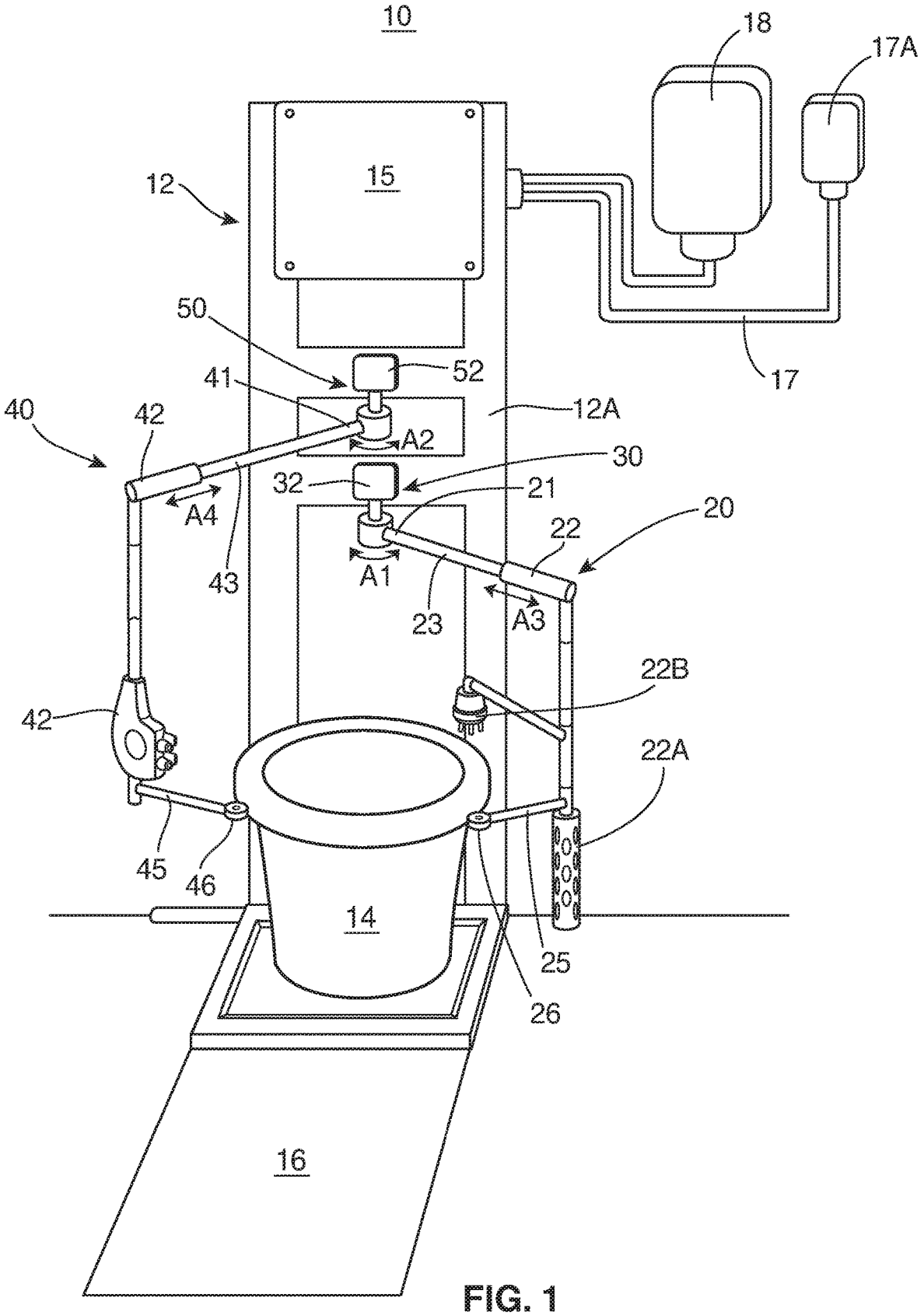
FIG. 1 is a front perspective view of the automated toilet cleaning system as disclosed in accordance with at least one embodiment of the present invention.

In particular, with reference to FIG. 1, the automated cleaning system 10 of at least one embodiment includes a number of components mounted to a support structure 12. The support structure 12 shown in FIG. 1 is a frame that can be easily installed in new bathrooms or retrofitted into existing bathrooms without the need for extensive reconstruction. For example, as will be described herein, the frame may be mounted to the floor proximate the bottom of the toilet and extend up above the toilet. Accordingly, the support structure 12 may extend directly above or proximate a toilet 14, such that, during a cleaning process, surfaces of the toilet 14 can be easily reached and cleaned. In one embodiment, the support structure 12 or frame include a metal or other rigid structure which allows at least some of the components described herein to be mounted, either directly or indirectly. The support structure 12 may include a plurality of mounting holes which allow the support structure 12 to be attached to a floor, wall or other surface via a plurality of screws, nails, or other fasteners.

Figure 2:
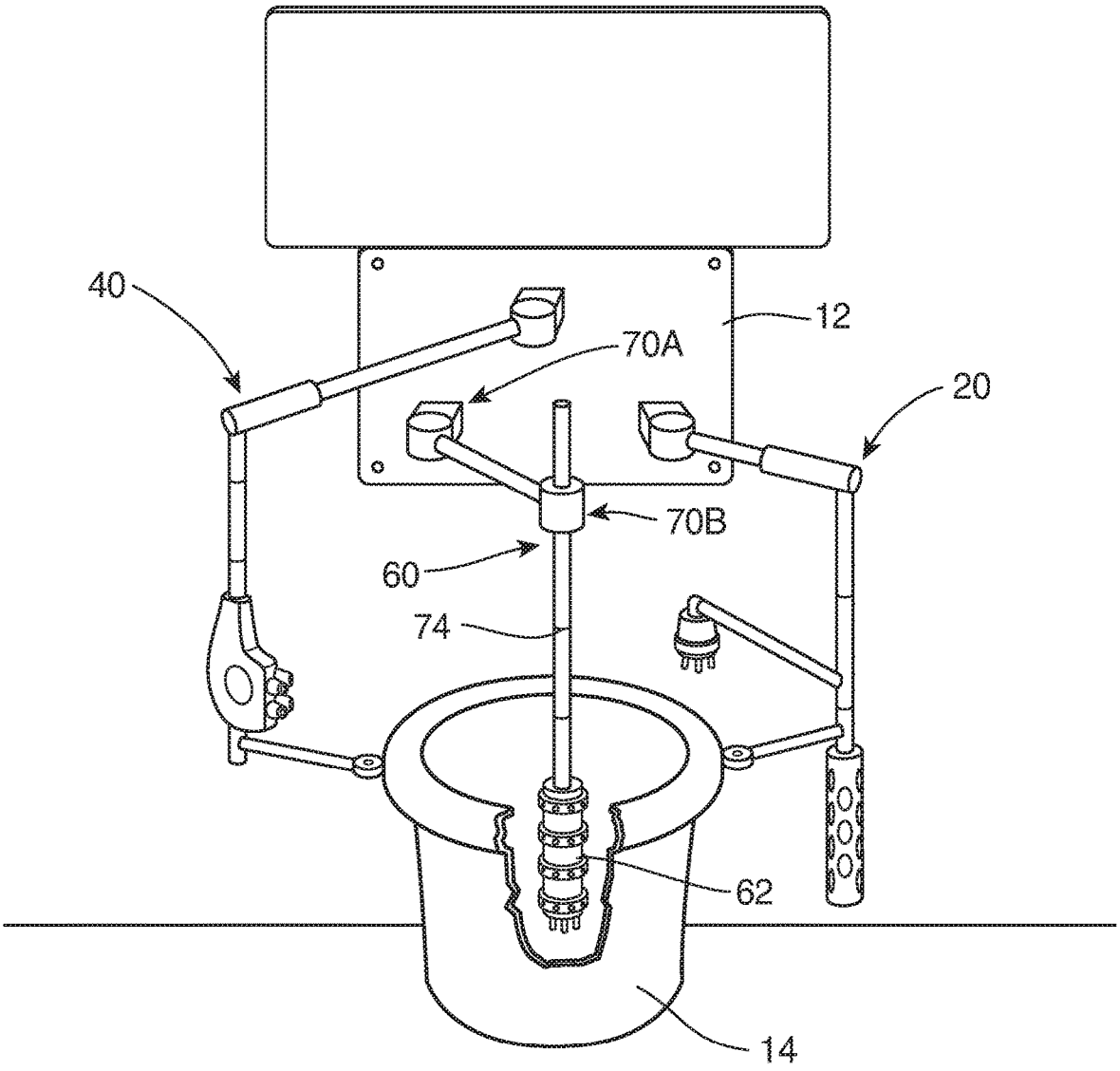
FIG. 2 is a partial front perspective view of another embodiment of the automated toilet cleaning system as disclosed herein.

In other embodiments, the support structure 12 may be in the form of a base plate, e.g., FIG. 2, which can be mounted directly to a wall 5, ceiling or other support surface within a bathroom. It is also contemplated that, in at least one embodiment, the cleaning system 10 may be installed or mounted in a number of different manners, some of which may include a mounting base or frame while others may not. As an example, at least some of the components of the cleaning system 10 may be mounted directly to the floor, wall or other support surface, including wall studs, beams, etc.

In any event, the cleaning system 10 of at least one embodiment includes a control device or assembly 15. The control device or assembly 15 includes various computer devices, components and electronics, including, for example, one or more computer processors, memory, and/or other control circuits and logic to implement the system and methods as disclosed in accordance with at least one embodiment of the present invention. For example, the control device 15 may be communicative with one or more activation devices to activate or start a cleaning process or cycle, one or more cleaning arm assemblies or positioning assemblies to move, activate and operate one or more water or fluid nozzles, cleansing solution distribution, brush heads, air (or other) driers, etc.

Particularly, the cleaning system 10 of at least one embodiment includes at least one cleaning arm assembly 20, 40 operationally communicative with the control device 15. Each cleaning arm assembly (e.g., first cleaning arm assembly 20 and second cleaning arm assembly 40) includes a positioning assembly (e.g., first positioning assembly 30 and second positioning assembly 50) and at least one cleaning end or cleaning apparatus 22A, 22B, 42. The first and second positioning assemblies 30, 50 are configured to position the corresponding cleaning arm assembly 20, 40 and cleaning apparatus 22A, 22B, 42, in proximity to the toilet 14, directed toward the toilet 14, and in some cases, such as when the cleaning apparatus is a brush, in contact or engagement with the toilet 14.

Furthermore, the cleaning assemblies 20, 40, and in particular, the positioning assemblies 30, 50 thereof, include a positioning arm 32, 52 to which the cleaning end or cleaning device 22, 42 is attached. Accordingly, as the positioning arm(s) 32, 52 move, the cleaning devices 22, 42 also move, for instance, with the movement of the corresponding positioning arm 32, 52. In one exemplary embodiment, the positioning arms 32, 52 may be at least partially telescopic in that an extension arm 33, 53 may extend or retract. In other embodiments, regardless of whether the positioning arm 32, 52 includes a telescopic extension arm 33, 53, the entire positioning arm 32, 52 may move, for example, in an upward and/or downward direction, as is described herein. Still referring to FIG. 1, the positioning assemblies 30, 50 of at least one embodiment include rotational or angular drive components, such as motor or driver 32, 52 configured to angularly or rotationally drive or move the corresponding cleaning arm assembly 20, 40 in a rotational or angular direction relative to the support structure 12 or relative to the toilet 14. For example, as represented by arrow A1, positioning assembly 30 is structured to rotationally drive or position corresponding arm assembly 20 at least partially around the toilet 14. This allows cleaning apparatuses 22A and 22B to move about the exterior or the toilet 14 for purposes of cleaning, as disclosed herein. Similarly, as represented by arrow A2, positioning assembly 40 is structured to rotationally drive or position corresponding arm assembly 40 at least partially around or about the exterior of the toilet 14. This allows cleaning apparatuses 42 to move about the exterior or the toilet 14 for purposes of cleaning, as disclosed herein. Accordingly, positioning assemblies 30, 50 may include a number of gears, motors, shafts, or other drive assemblies capable of facilitating the angular or rotational movement of the corresponding arm assembly. In some embodiments, the arm assemblies 20, 40 may move approximately one hundred and eighty (180) degrees about the exterior of the toilet, although other rotational distances or angles are contemplated.

Furthermore, still referring to FIG. 1, the arm assembly 20, 40 of at least one embodiment includes a biased arm section, represented as 22, 42, respectively. The biased arm section is linearly extendable toward and away from the mounted end 21, 41 of the corresponding arm assembly 20, 40.

For example, biased arm section 22 is movable in a linear direction A3 toward and away from the end 21 via a biasing device (not shown), such as a mechanical spring or other device capable of facilitating similar linear movement. For instance, a spring or other biasing device may be mounted inside and between biased arm section 22 and shaft or arm 23, wherein the shaft or arm 23 is linearly fixed and biased arm section 22 is linearly movable in direction A3. Specifically, biased arm section 22 may be normally biased (i.e., in a relaxed state) toward the mounted end 21 or shaft or arm 23. However, when an outward force (e.g., in a direction away from the end 21) greater than the normal biasing force is exerted upon the biasing device, the biased arm section will extend outward and away from end 21.

Similarly, biased arm section 42 is movable in a linear direction A4 toward and away from the end 41 via a similar biasing device (not shown), such as a mechanical spring or other device capable of facilitating similar linear movement. For instance, a spring or other biasing device may be mounted inside and between biased arm section 42 and shaft or arm 43, wherein the shaft or arm 43 is linearly fixed and biased arm section 42 is linearly movable in direction A4. Specifically, biased arm section 42 may be normally biased (i.e., in a relaxed state) toward the mounted end 41 or shaft or arm 43. However, when an outward force (e.g., in a direction away from the end 41) greater than the normal biasing force is exerted upon the biasing device, the biased arm section will extend outward and away from end 41.

Moreover, still referring to FIG. 1, at least one embodiment of the present invention also includes a spacer arm 25, 45 extending from a portion of a corresponding cleaning arm assembly 20, 40 toward the toilet 14. For instance, spacer arm 25 extends from the arm assembly 20 in a generally horizontal (although not necessarily limited to horizontal) direction toward the toilet. The spacer arm 25 includes a distal end 26 which engages or otherwise contacts the outer surface of the toilet 14. In some embodiments, the distal end 26 includes a roller, wheel, or smooth pad that will allow the distal end 26 to easily traverse along the exterior surface of the toilet 14. Accordingly, the spacer arm 25 of at least one embodiment is a rigid and fixed arm that maintains the corresponding cleaning apparatus 22A in a spaced relation from the toilet during a cleaning cycle.

Similarly, spacer arm 45 extends from the arm assembly 40 in a generally horizontal (although not necessarily limited to horizontal) direction toward the toilet 14. The spacer arm 45 includes a distal end 46 which engages or otherwise contacts the outer or exterior surface of the toilet 14. In some embodiments, the distal end 46 includes a roller, wheel, or smooth pad that will allow the distal end 46 to easily traverse along the exterior surface of the toilet 14. Accordingly, the spacer arm 45 of at least one embodiment is a rigid and fixed arm that maintains the corresponding cleaning apparatus 42 in a spaced relation from the toilet during a cleaning cycle.

More in particular, as the positioning assembly 30, 50 rotationally drives or moves the corresponding arm assembly 20, 40 around the toilet 14, the spacer arms 25, 45 will roll or traverse against the toilet 14 so as to keep the corresponding cleaning apparatus a spaced distance from the toilet. As the arm assembly 20, 40 moves about the toilet 14 in a rotational direction, the spacer arms 25, 45 may cause a force to be exerted upon the biasing device or spring that biases the biased arm sections 22, 42. This can cause the biased arm sections 22, 42 to extend linearly outward as the arm assembly 20, 40 moves around the toilet 14. As the force releases, the biasing arm sections will retract toward the mounted end 21, 41. This maintains the cleaning apparatus 22A, 42 an/d or arm assembly 20, 40 a spaced distance from the toilet during the cleaning cycle.

Still referring to FIG. 1, the automated toilet cleaning system 10 of at least one embodiment of the present invention includes at least one fluid input, generally referenced as 17, for receiving a flow of fluid, such as water, from a water source 17A The input 17 is fluidically interconnected, either directly or indirectly, to one or more of the cleaning ends e.g., 22A, 22B such that water or fluid flowing into or through the input 17 can controllably flow to and be released or dispensed from one or more of the cleaning apparatuses 22A, 22B.

It should be noted that the water or fluid input 17 can be directly connected to the one or more cleaning arm assemblies 20 via one or more hoses, pipes or other connections. In the illustrated embodiment, the water or fluid may flow into through input 17, for example, via a water source 17A (e.g., water source of the building, restroom or structure) by one or more pipes, connectors, tubes, conduits, etc. Additional pipes, tubes, hoses, etc. can flow from the input 17 to the cleaning arm assemblies 20, for example, internally through the various components of the positioning assemblies 30 or externally (not shown).

It should also be noted that the cleaning system 10 of at least one embodiment may have a plurality of water or fluid inputs 17, for example, for hot and cold water input. The various cleaning arm assemblies 20 may share the same water inputs 17 or, in some cases, may have independent inputs 17.

Furthermore, at least one embodiment of the present invention also includes a cleaning solution chamber 18 for retaining an amount of cleaning solution, such as soap, disinfectant, bleach, water, mixture, etc. In some embodiments, the invention includes a cleaning solution flow meter connected to the chamber and structured to monitor the level of cleaning solution therein. For example, if the level of cleaning solution drops below a certain predetermined volume or amount (e.g., 25%), the system can add water to the chamber to increase the level.

In any event, the cleaning solution chamber 18 is fluidically interconnected, either directly or indirectly, to one or more of the cleaning ends 22A, 22B such that a cleaning solution flowing from the chamber 18 can controllably flow to and be released or dispensed from one or more of the cleaning ends or devices 22.

Figure 3:
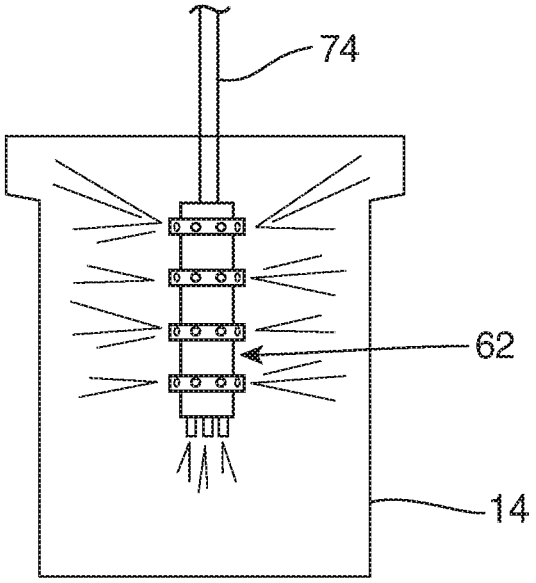
FIG. 3 is a partial interior view of a toilet bowl with a cleaning apparatus disposed therein.

With reference now to FIGS. 2 and 3, at least one embodiment of the present invention includes an inner bowl cleaning arm assembly, referenced as 60, with an inner bowl cleaning apparatus 62 connected thereto. The apparatus 62 may be in the form of a toilet brush, spray nozzles, cleaning solution dispensers, or any combination thereof. In particular, the inner bowl cleaning arm assembly 60 includes a positioning assembly 70A, 70B to movably position the apparatus 72 into and out an interior of the toilet 14, such as the toilet bowl.

For example, positioning assembly 70A of at least one embodiment interconnects with an end of the arm assembly 60 and is structured to angularly position the arm assembly 60 relative to the support structure 12 or toilet 14. In one embodiment, the angular positioning may be along a horizontal plane such that positioning assembly 70A positions the cleaning apparatus 62 above the toilet bowl by rotating the arm assembly 60 horizontally, while positioning assembly 70B is configured to vertically position the cleaning apparatus 62 into and out of the toilet bowl.

In at least one embodiment, positioning assembly 70 includes a motor and corresponding component(s) such as one or more shafts, gears, etc. to accomplish the angular or rotational movement. Positioning assembly 70B may include a motor, pulleys, gears, etc. configured to drivingly move shaft 74 up and down, or otherwise in a vertical direction into and out of the toilet bowl.

FIG. 3 represents the cleaning apparatus 62 of at least one embodiment disposed on the interior of the toilet bowl and spraying fluids, such as water and cleaning solution therein during a cleaning cycle.

In addition, with reference now to FIGS. 4 through 7, at least one embodiment the present invention may include a base in the form of an angled floor surface, tray or collection plate, referenced as 80. In particular, the surface 80 is positioned below the cleaning arm assemblies 20, 40, 60 and provided a surface in which the water and fluids sprayed by the system 10 can be collected and drained.

For instance, in at least one embodiment, the base includes an outer frame section 82 and an inner recessed surface 84. The water or fluid sprayed or produced by the present invention can be collected or otherwise can fall onto the base 80, and in particular, into the recessed inner surface 84 thereof. The base 84 may include a drain (not shown) through which the water or fluids can be directed. A drain pipe 86 will then drain the water or fluid, for example, to the main bathroom drain lines. In some embodiment, the base 80 includes an angled surface such that the fluid will be directed toward the drain.

Additionally, frame 12 of at least one embodiment may be secured to the floor and/or wall adjacent the toilet. This allows the system 10 to be easily installed in existing bathrooms or in new construction bathrooms. For example, with reference to FIGS. 2 and 4, the frame 12 includes an upper mounting section 12A and one or more feet or bases 12B. The cleaning arm assemblies 20, 40, 60 and other components of the present invention may be mounted to the upper mounting section 12A of the frame 12. The base or feet 12B of the frame 12 may form an L-shape, and provide stability for the frame 12. For instance, the base or feet 12B can be secured or bolted directly to the floor via bolt holes, while the upper mounting area extends upward generally above the toilet. The upper mounting area of the frame 12 can in some case also be fixed, for example, by attaching it to the wall or wall studs via screws, bolts, etc.

Figure 5:
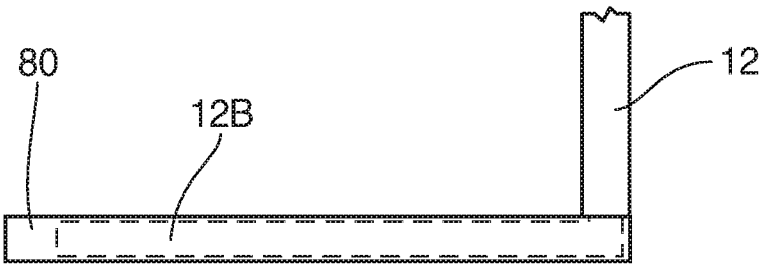
FIG. 5 is a partial side plan view of the base and support structure as disclosed in accordance with at least one embodiment of the present invention.
Figure 6:
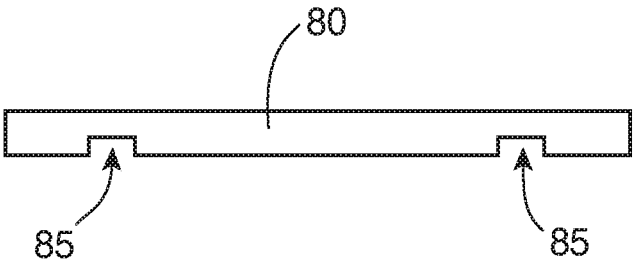
FIG. 6 is a rear plan view of the base disclosed in FIG. 5.
Figure 7:
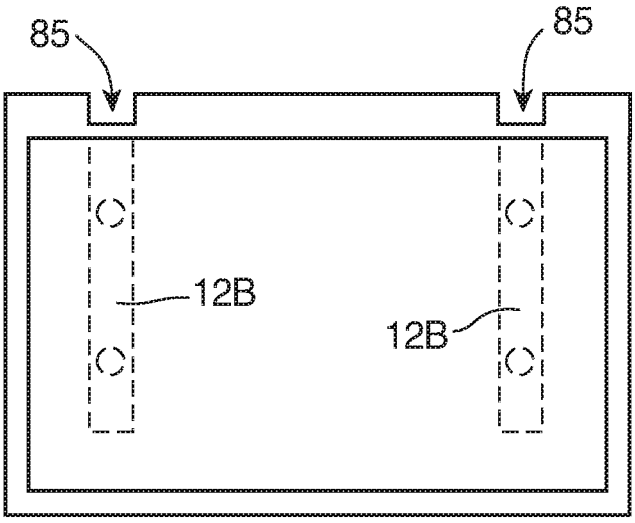
FIG. 7 is a top view of the base and partial view of the support structure as disclosed herein.

With reference to FIGS. 5, 6 and 7, the base plate 80 of at least one embodiment is disposed in an at least partially overlying relation with the base or feet 12B of the frame 12. In this manner, once the frame 12 is secured to the floor, the base plate 80 is positioned on top of the feet 12B. Corresponding channels 85 may be provided in the base plate 80 to receive the feet 12B of the frame.

Furthermore, the cleaning system 10 of at least one embodiment further includes an activation device 16 that is structured to activate a cleaning cycle of the automated toilet cleaning system 10 of the present invention. It should be noted that in some cases, the activation device 70 of at least one embodiment is separate and independent of a toilet flush sensor (e.g., a sensor which activates a toilet flush when the user vacates the vicinity). In other words, in at least one embodiment, the cleaning system 10 must be separately activated via activation device 16, and will not automatically activate after every toilet flush. In other embodiments, however, the cleaning system 10 can activate automatically after every toilet flush, after a certain number of toilet flushes, at a set day and time, etc.

Figure 4:
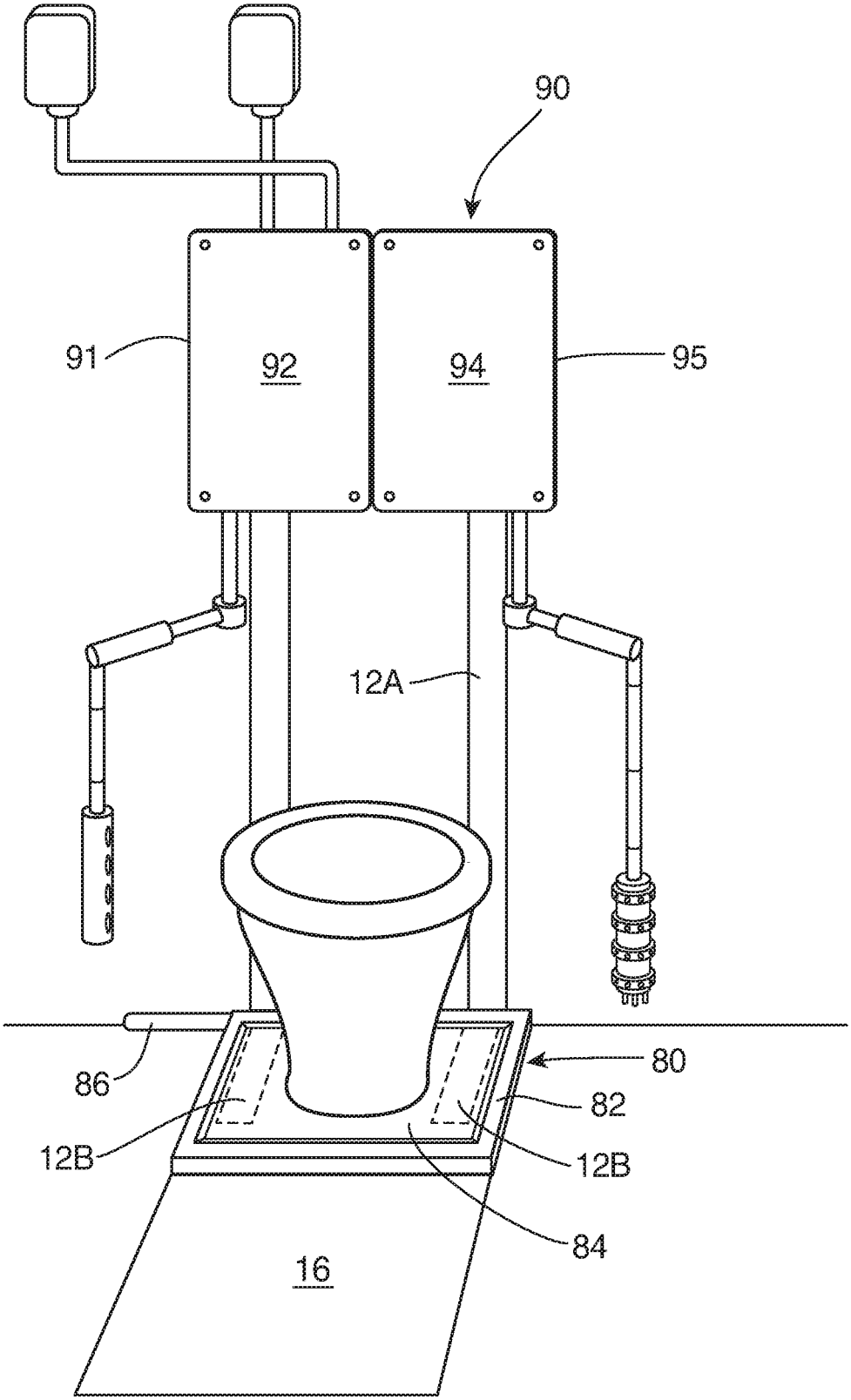
FIG. 4 is a front perspective view of yet another embodiment of the automated toilet cleaning system as disclosed herein.

With reference to FIGS. 1 and 4, in at least one embodiment, the activation device 16 may be in the form of a weight sensor, for example, on a mat, disposed immediately in front of the toilet 14. The weight sensor may be configured to recognize when a force or weight above a predetermined threshold (e.g., above 30 pounds) is present on the mat. If so, then system 10 will not activate a cleaning cycles, as this would indicate that a patron is still present in the stall. Once the patron leaves, and the weight is removed from the sensor, mat or activation device, a cleaning cycle may begin.

In other cases, a user can selectively activate the cleaning system 10 via activation device 16, which may be in the form of a button, switch, lever, pull cord, etc. Activation device 70 can, in some cases, be voice activated, such that voice command from the user or other individual can activate a cleaning cycle.

In any event, when a cleaning cycle is activated in accordance with at least one embodiment of the present invention, the control device 15 will operate to movably position one or more of the cleaning arm assemblies 20, 40, 60 and/or one or more of the corresponding cleaning apparatuses 22, 42, 62 thereof in order to orient the cleaning apparatuses 22, 42 toward the toilet 14. A flow of water and/or cleaning solution may be directed from the input 17 to one or more of the cleaning ends 22, 42 toward the toilet.

For example, in one embodiment, one of the cleaning arm assemblies, such as the first cleaning arm assembly 20 may provide brushless, fluid cleaning in that the one or more cleaning apparatuses 22A, 22B of the first cleaning arm assembly 20 includes spray nozzles or other devices configured to spray or otherwise dispense water, fluids, and/or cleaning solution toward the toilet. Accordingly, when the first cleaning assembly 20 is activated, the corresponding positioning assembly 40 can movably dispose the arm assembly 20 in an angular or rotational movement while the spacer arm 25 maintains contact the with external surface of the toilet. The biased arm section 22 can extend and retract as the arm assembly moves around the toilet 14. The cleaning apparatus 22A, 22B can spray water and cleaning solution onto surfaces if the toilet, including the external surfaces, the top edge (e.g., where a patron may sit), and/or inside the toilet. If the cleaning apparatus 22A, 22B has a brush, cleaning pad, or other like device, it may contact the toilet during the cleaning cycle.

If the system 10 includes an inner bowl arm assembly 60, for example, as illustrated in FIGS. 2 and 3, the control device 15 may activate the corresponding positioning assembly 70A, 70B in order to horizontally and vertically orient the corresponding cleaning apparatus 62 at least partially inside the bowl. In the illustrated embodiment, the cleaning apparatus 62 includes a plurality of spray heads or spray nozzles that are configured to direct a flow of water and/or cleaning solution on to the interior surface of the toilet bowl for cleaning.

In some embodiment, another cleaning arm assembly 40 may be included in order to provide hot or warm air onto the toilet surface(s). For example, cleaning apparatus 42, as illustrated in FIG. 1, may include an air blower which is configured to direct a flow of air, preferably warm or hot air, onto the surfaces of the toilet. This is generally done after the system 10 has sprayed water or cleaning solutions, for example, via one or more of the other arm assemblies 20, 60.

It should be noted that the various cleaning arm assemblies 20, 40, 60 may be activated at the same time or different times independent of one another.

It should also be noted that the toilet 14 of at least one embodiment of the present invention smooth surfaces, lacks a lifting seat, and in some embodiments also lacks a cover. In some cases, the toilet may be constructed of a single mold or a piece in order to minimize or eliminate hard-to-reach surfaces, for purposes of cleaning. For instance, conventional toilets or commodes often have many grooves, cracks, creases, exposed screws, etc. that are difficult to clean or keep clean. The toilet 14 or commode of at least one embodiment the present invention is more pleasant to the eye and easier to clean.

With reference to FIG. 4, a cover 90 or cabinet assembly of at least one embodiment is illustrated. The cover 90 can cover or hide at least some of the components of the cleaning system 10. For example, the cover 90 of at least one embodiment may include two pivoting cabinet doors 92, 94 that pivot open and closed on the outermost ends 91, 95. Particularly, FIG. 4 illustrates the cover 90 disposed in the closed position wherein at least some of the cleaning system 10 is hidden there behind. During operation of the cleaning system 10, for example, when the cleaning system 10 is operatively spraying water, cleaning solution or scrubbing the toilet, the cover or cabinets 90 of at least one embodiment may be disposed in an open orientation, thereby exposing the cleaning system 10 similar to that shown in FIG. 1. For example, the left cabinet door 92 may pivot open via a hinge or other like device on the left edge 91, whereas the right door 94 may pivot open via a hinge of other like device on the right edge 95. Once the cleaning cycle is over, or otherwise when the cleaning system 10 is not in use, the cabinet doors 92, 94 may pivot into the closed orientation. Other covers 90 are also contemplated, including retractable doors, sliding doors, folding doors, etc. In other embodiments the cabinet 90 may conceal some of the components of the present invention, such as the control device 15, at least some of the positioning devices, etc. even during operation of a cleaning cycle.

Figure 8:
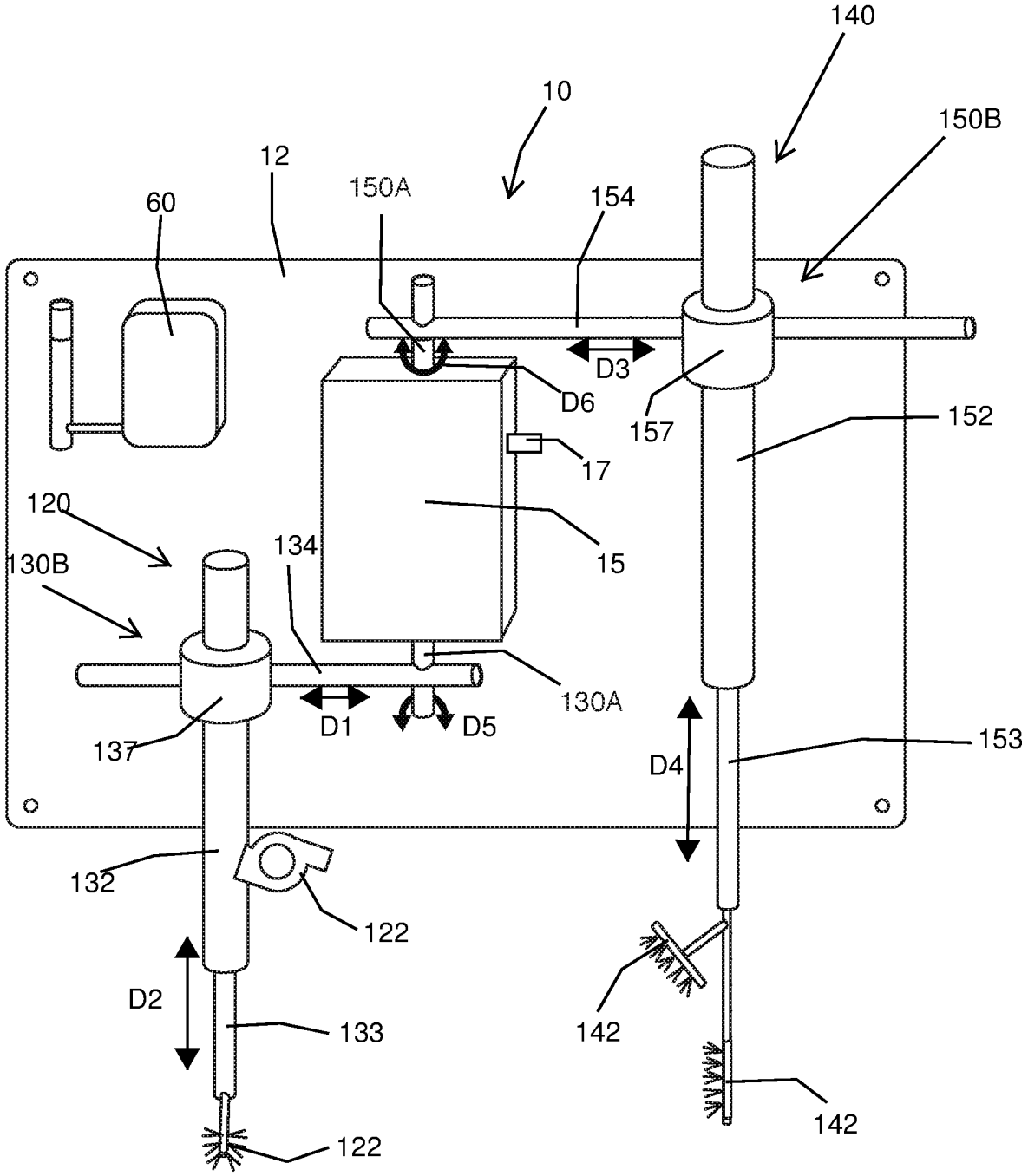
FIG. 8 is a front perspective view of yet another embodiment of the automated toilet bowl cleaning system disclosed herein.
Figure 9:
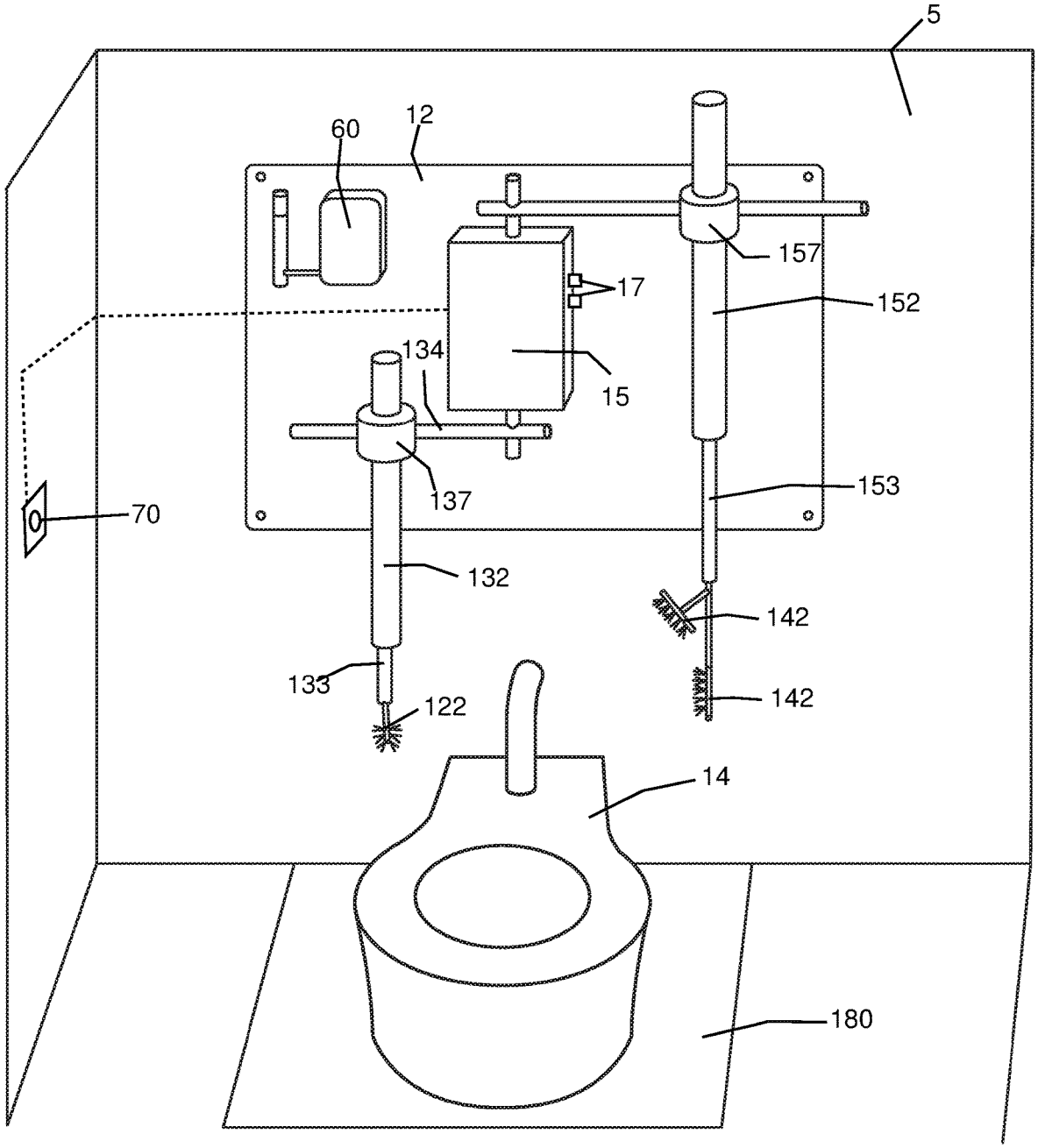
FIG. 9 is a front perspective view of the automated toilet bowl cleaning system installed in a bathroom, as disclosed herein.

Referring now to FIGS. 8 and 9, yet another embodiment of the toilet cleaning system 10 is illustrated. In particular, a first cleaning arm assembly 120 may include a first positioning assembly, referenced as 130A, 130B, and a second cleaning arm assembly 140 may include a second positioning assembly 150A, 150B. For example, the first positioning assemblies 130A and 150A are structured to angularly or rotationally move the corresponding arm assembly 130, 150 relative to the support structure 12 or toilet 14. The second positioning assemblies 130B, 150B are structured to linearly move a portion of the corresponding arm assembly 120, 140, for examine in a vertical orientation.

In this manner, the arm assemblies 120, 140 may each include a shaft, e.g., a first shaft 134 and a second shaft 154. The shaft 134 connects between positioning assembly 130A and positioning assembly 130B. Positioning assembly 130A will angularly move the shaft 134 relative to the support structure 12. Similarly, the shaft 154 connects between positioning assembly 150A and positioning assembly 150B. Positioning assembly 150A will angularly move the shaft 154 relative to the support structure 12.

Furthermore, in at least one embodiment, arms 133, 153 are movably disposed along the corresponding shaft 134, 154 in order to move the cleaning ends or devices 122, 142 in a first or horizontal direction. Alternatively, in another embodiment, the positioning arms 132, 153 may be fixed relative to the corresponding shaft 134, 154, and therefore, movement of the entire shaft 134, 154 in a first direction, such as a horizontal direction, causes the corresponding positioning arms 132, 152, and consequently, the corresponding cleaning ends or devices 122, 142 to move.

Further, movement of the cleaning apparatuses in another direction, such as a vertical direction, is accomplished by movement of the arms 132, 152 in a vertical direction. For example, in at least one embodiment, the positioning arms 132, 152 include an extension 133, 153 which is telescopically movable or otherwise extendable and retractable in order to move, extend or retract the cleaning ends or devices 122, 142. In an alternative embodiment, or in addition to the telescopic extensions 133, 153, the positioning arms 132, 152 may be movably disposed relative to the corresponding shaft 134, 154 in a second direction, such as in a vertical direction. In this manner, movement of the positioning arms 132, 152 in a vertical direction relative to the corresponding shaft 134, 154 causes the cleaning apparatuses 122, 142 to also move in the vertical direction.

Moreover, the shafts 134, 154 may pivot, swing or move outward from the wall 5 or support structure 12, allowing the positioning assemblies 130, 150, and therefore, the corresponding cleaning apparatuses 122, 142 to move in a third direction, for example, in a three-dimensional direction away from and toward the support structure 12. Other pivoting points, junctures, and moving shafts and arms are contemplated in accordance with the various embodiments disclosed herein.

Furthermore, at least one embodiment of the present invention also includes one or more motors or drive assemblies, generally referenced as 137 and 157. The drive assemblies 137, 157 of at least one embodiment at least partially control the movement of the positioning arms 132, 153 and/or the positioning shafts 134, 154.

For example, drive assembly 137 may function to movably dispose the extension arm 133 up and down, or in other directions, thereby, extending and retracting the corresponding cleaning apparatus 122. In addition, drive assembly 137 may function to movably dispose the positioning arm 132 in a horizontal and/or vertical relation relative to the positioning shaft 134. In alternative embodiments, the drive assembly 137 may function to movably dispose the shaft 134, in a horizontal and/or three-dimensional direction, thereby also moving the cleaning apparatus 122.

Similarly, drive assembly 157 may function to movably dispose the extension arm 153 up and down, or in other directions, thereby, extending and retracting the corresponding cleaning devices 142. In addition, drive assembly 157 may function to movably dispose the positioning arm 152 in a horizontal and/or vertical relation relative to the positioning shaft 154. In alternative embodiments, the drive assembly 157 may function to movably dispose the shaft 154, m a horizontal and/or three-dimensional direction, thereby also moving the cleaning ends 142.

In this manner, the first arm 132, and therefore the corresponding cleaning apparatus 122, is/are movably disposed in a first direction, represented by D1 and a second direction, represented by D2. Similarly, the second arm 152, and therefore the corresponding cleaning apparatus 142, is/are movably disposed in a third direction, represented by D3 and a fourth direction, represented by D4. In the embodiment illustrated, the first D1 and third D3 directions are at least substantially horizontal and the second D2 and fourth D4 directions are at least substantially vertical. In addition, the first shaft 34 is pivotable or movable inward and outward relative to the wall 5 or support structure 12 in a fifth direction D5. Similarly, the second shaft 54 is pivotable or movable outward relative to the wall 5 or support structure 12 in a sixth direction D6. The fifth and sixth directions being three-dimensional directions toward and away from the reader.

It should be noted that drive assemblies 137, 157 may include various belts, pulleys, gears or other mechanical or electrical structures configured to movably dispose the various components as described in accordance with the various embodiments herein. Furthermore, the cleaning system 10 of at least one embodiment may include additional drive assemblies, for example, within control device 15 to effectuate movement of the positioning assemblies 130, 150 described herein.

Figure 10:
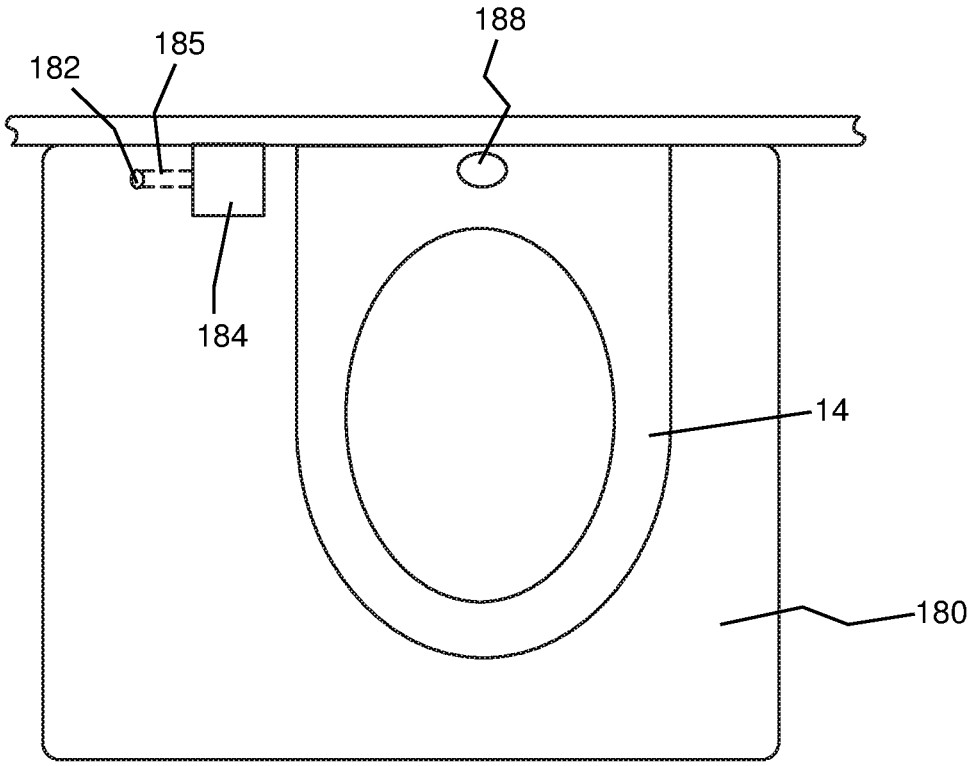
FIG. 10 is a top view of the toilet and angled tray as disclosed in accordance with at least one embodiment of the present invention.
Figure 11:
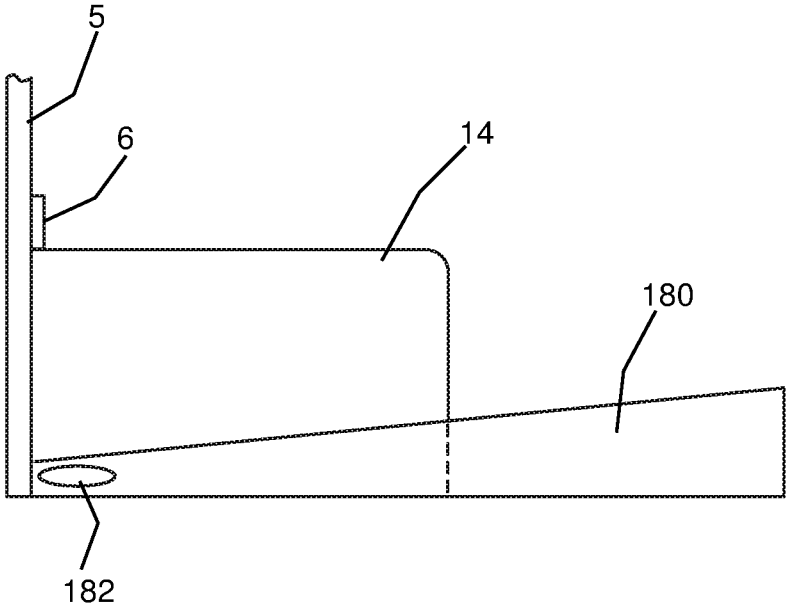
FIG. 11 is a side view of the toilet and angled tray as disclosed in accordance with at least one embodiment of the present invention. Notably, the angle of the angled tray is exaggerated for purposes of discussion only.

FIGS. 10 and 11 represent side schematic views of the toilet 14 and bottom base or tray 8*p* in accordance with one embodiment. For instance, the tray or base 180 may include downward sloped surface directed toward a drain 182. It should be noted that the angle shown in FIG. 11 is exaggerated in order to allow the viewer to realize that the tray or floor surface 180 is angled toward the drain 182 such that all fluids that contact the floor surface 182 will naturally flow down toward the drain 182. The toilet 14 may, in some embodiments, be mounted to or near wall 5, to which the cleaning assemblies are also mounted, either directly or indirectly. Furthermore, a drain pump 184 may be connected to the drain 182 via piping 185 beneath the floor or try surface to direct all captured fluids to the drain. Toilet 14 may also include sensing device 188 to trigger a flush, for example, when a user has left the vicinity of the device 188.

Figure 13:
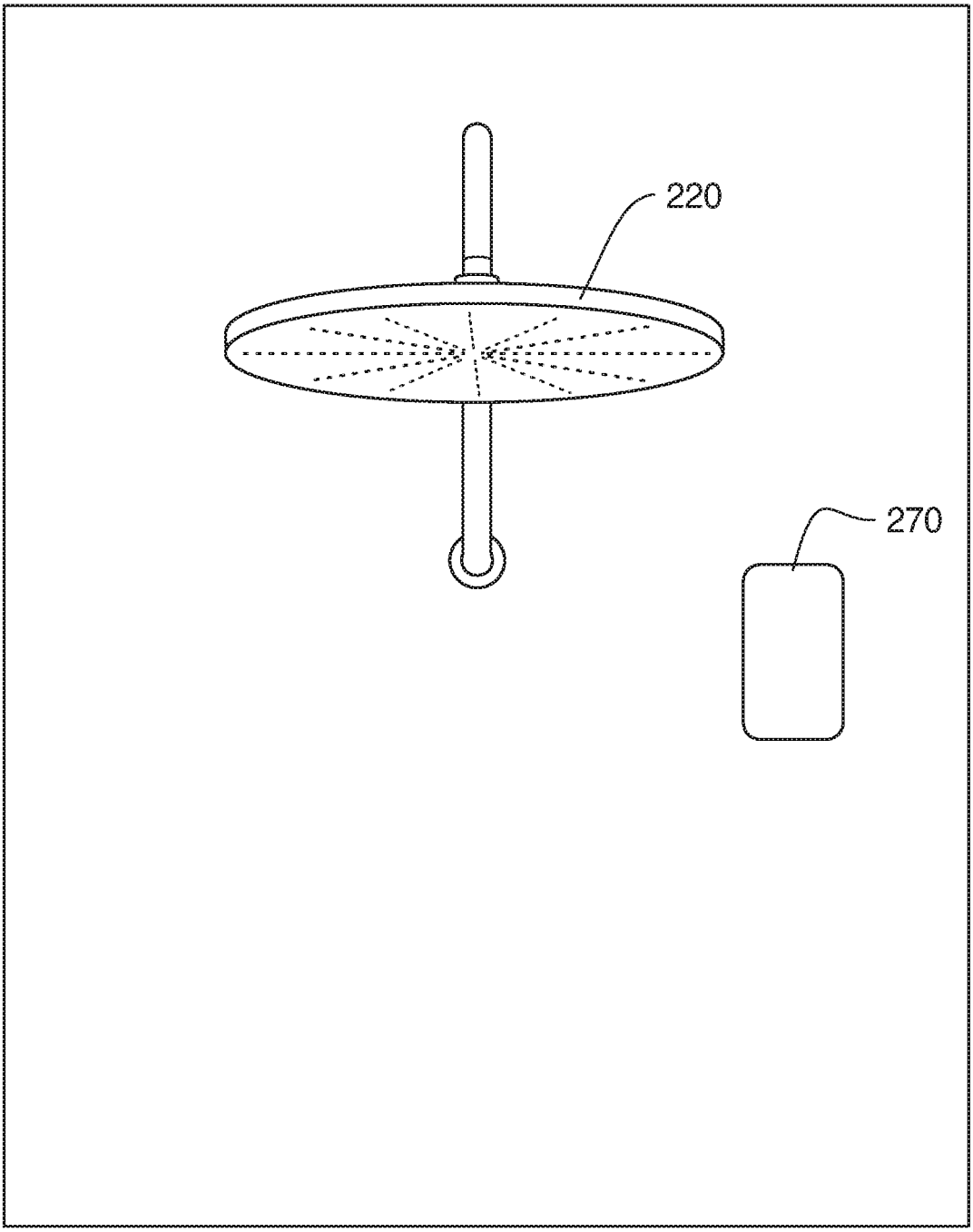
FIG. 13 is a front view of the shower assembly as disclosed in accordance with at least one embodiment of the present invention.

With reference now to FIGS. 12 through 15, a shower assembly 200 is illustrated. In particular, and with reference to FIGS. 12 and 13, shower assembly 200 includes a shower head 220 installed or otherwise mounted in a shower area. For instance, the shower head 220 may be mounted to a wall 7 or otherwise mounted or disposed on one side of the wall 7, i.e., the side of the all that defines the area within which a user will shower.

On the other side of the wall 7, or otherwise in a different location, the shower assembly 200 includes a plurality of other components, including, for example, a water tank 240, a water pump 250 and a control device 260.

Figure 15:
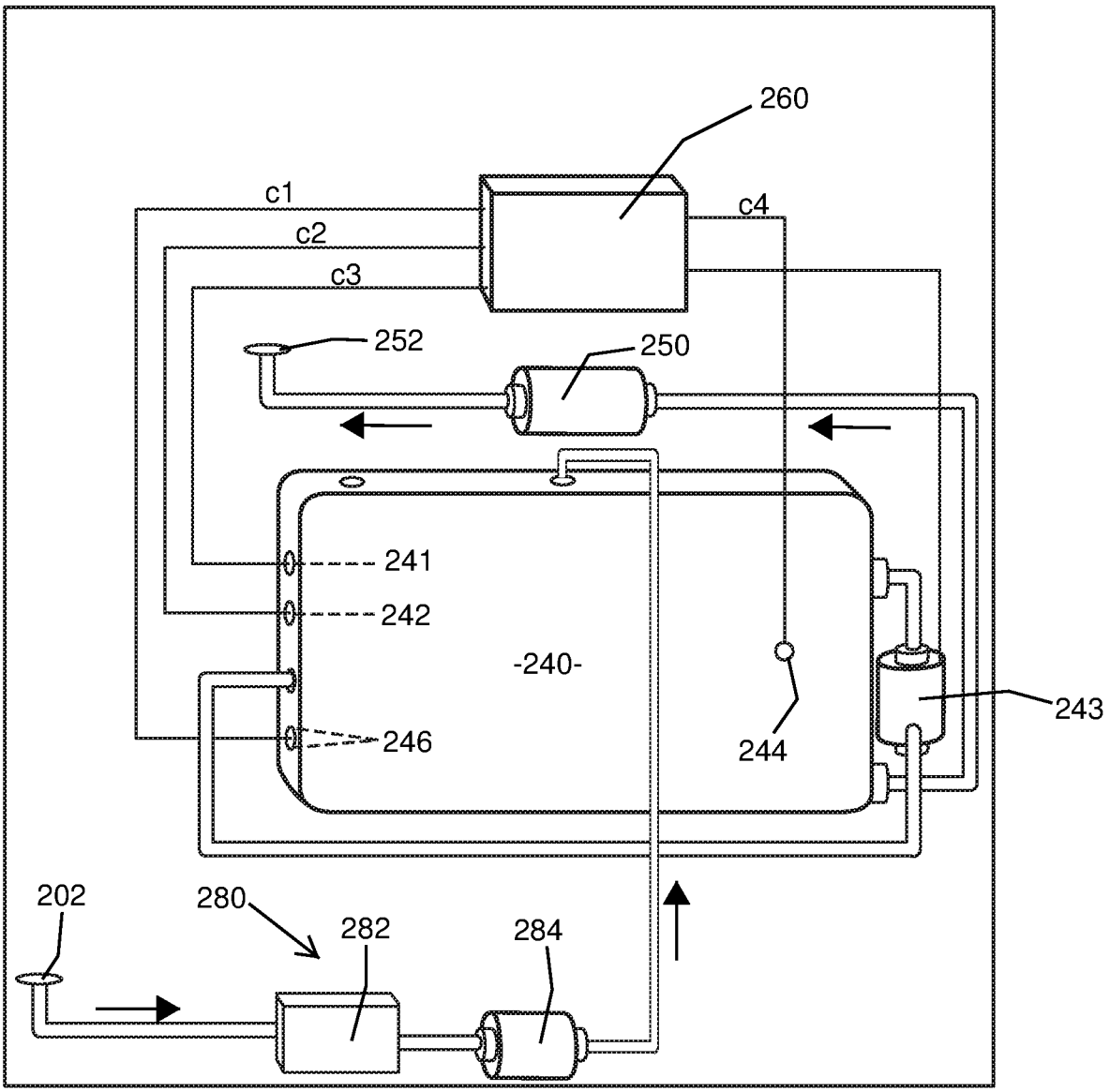
FIG. 15 is a schematic representation of some components of the shower assembly as disclosed in accordance with at least one embodiment herein.

For instance, with reference to the schematic illustrated in FIG. 15, the inside of the shower head 220 is illustrated as being fluidically interconnected to the pump 250, which is fluidically interconnected to the water tank 240. Also illustrated is a user panel 170. In at least one embodiment, the shower head 220 is an enlarged shower head having a width of approximately two (2) feet, and a length of approximately two (2) feet. Other dimensions larger or smaller are contemplated within the full spirit and scope of the present invention.

Furthermore, the shower head 220 of at least one embodiment includes a matrix or grid of a plurality of outlets that deliver water at user-specified pressures. For instance, the shower head 220 includes an inlet or distribution hub 225 to which the water is initially provided. From the distribution hub 225, water is distributed evenly to the plurality of outlets or water jets.

Figure 14:
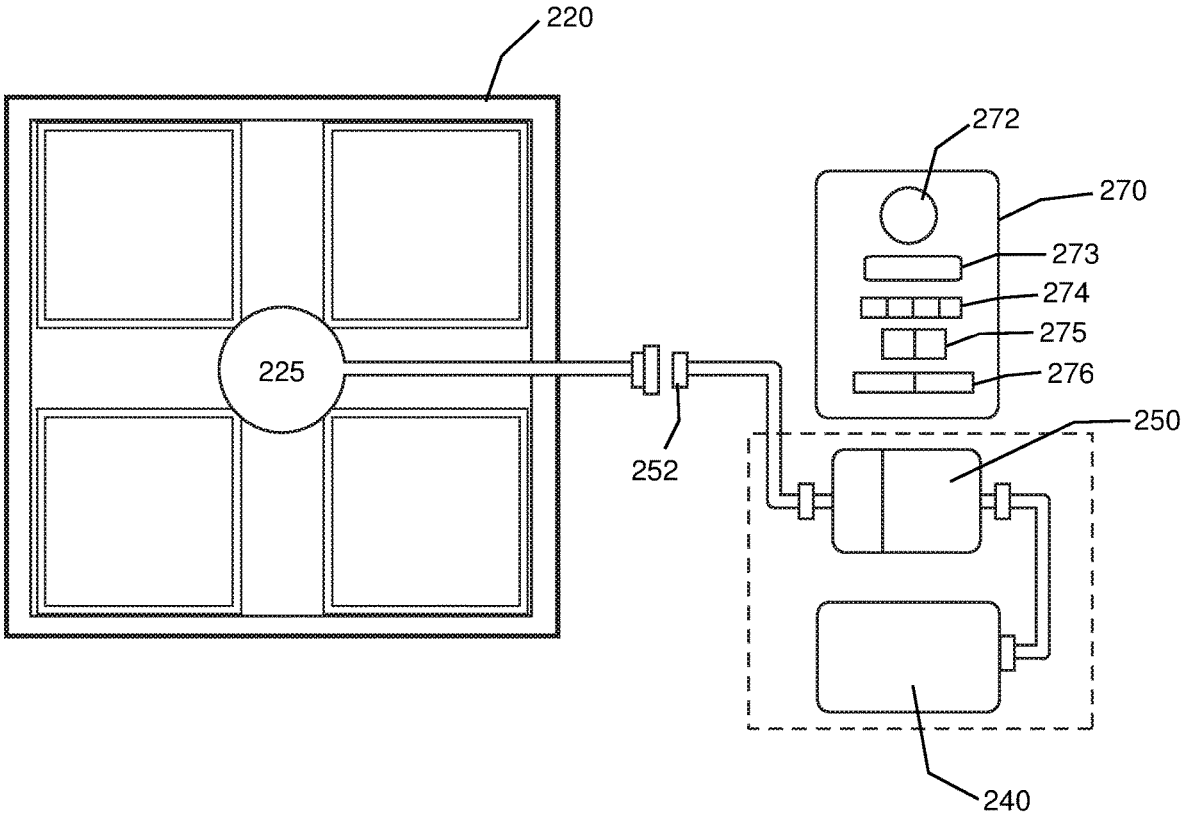
FIG. 14 is a schematic representation of the shower head and shower assembly as disclosed in accordance with at least one embodiment of the present invention.

Still referring to FIG. 14, the user panel 270 of at least one embodiment is a low voltage powered or electronic panel mounted within easy reach of the user within the showering area or just outside of the showering area. The user panel 270 is communicative with the control device 260. The control device 260 may be mounted on the opposite side of the wall 7 as the user panel 270, or in some cases, a distance away. In this manner, communication between the user panel 270 and the control device 260 may be via wireless communication (e.g., WiFi, Bluetooth, etc.) or a wired connection.

The water pump 250 includes a multiple speed impeller head, for example, but not limited to a four-speed impeller head, which allows the pump to operate at different pressure levels. In other words, the water pump can deliver water to the shower head 220 at different water pressures, selected by the user via the user panel 270.

The water tank 240 allows the system to produce its own hot or temperature-controlled water supply. For instance, the temperature-controlled water tank 240 can be mounted on the opposite side of the wall 7, along with the water pump 250.

With reference to the schematic of the user panel 270, a knob 272 or other selector can be used to manually select the water temperature. Upon turning the knob 272 or other selection device (e.g., buttons), display screen 273 displays the selected temperature, for example, in Celsius or Fahrenheit. Selection device 274 allows the user to select, via push button, roller, knob or the like, a water pressure level. In the exemplary embodiment, four different selection buttons are shown, one for a different water pressure level. Selection 275 provides an 'ON' or 'OFF' selection, to activate or deactivate the shower assembly 100. When the 'ON' is activated, water will pump from the tank 140, through the pump 150, to the shower head 220 (e.g., to the distribution hub 225, then to the plurality of outlet jets) at the selected temperature and selected water pressure. Display 276 shows the current status of the shower assembly 100, for example, either 'RUN' or 'STANDBY.'

Referring now to FIG. 15, the holding tank 240, pump 250 and control device 260 are shown as being installed on the reverse side of the wall 7. In particular, holding tank 240 is configured to retain an amount of water and heat or otherwise control the temperature of the water for use in the shower. In this manner, the shower assembly 100 of at least one embodiment includes a separate and dedicated hot water tank to minimize or eliminate running out of hot water during a shower.

For instance, reference 241 represents a float switch or other sensor that operates to mechanically turn the water intake off when the water level in the tank 240 reaches a predetermined top or maximum level. When the float switch 241 drops to or below a predetermined low level, the water intake will again turn on to fill the tank 240. This operates similar to the action of flushing a toilet.

Further, reference 242 represents another switch or sensor, such as a float switch, that will trigger an alarm or notification to the user in the shower that the water level in the tank 240 has reached a predetermined level, for example, when the water level in the tank 240 is half or less than half, the alarm or notification to the user will indicate that the temperature controlled water is almost empty and to leave the shower. The alarm or notification could also indicate a malfunctioning on switch 241.

Moreover, at least one embodiment also includes a recirculation pump 243 to recirculate water in the tank 240. This can help with maintaining a stable temperature in the tank 140.

It should be noted that a heating element 246 may be disposed within the tank 240 that includes a sufficient amount of power to heat the water in the tank 240 to a selected temperature level. The size and power of the heating element will largely depend on the size or capacity of the water tank 240. Thermostat or temperature detector 244 is disposed in the tank 240 to read or determine the temperature of the water therein. A venting hole 245 may be included to provide pressure relief from within the tank 240.

The water pump 250 will pump water from the tank 240 to the shower head 220. Reference character 252 represents the water line section through the wall although it should be noted that instead of fluid connections at 252, the pipe may be continuous.

Control device 260 includes one or more computer processors, memory and/or logic to operate the system 200 and method described herein. Control device is connected to the tank 240 via connections c1, c2, c3 and c4. For example, connection c1 connects the control unit or device 260 to the water heater or heating element 246. Connection c2 connects the control unit or device 260 to the switch or sensor 242, connection c3 connects the control unit or device 260 with the switch or sensor 241, and connection c4 connects the control unit or device 260 with the temperature sensor 244. In this manner, the control unit or device 260 is able to control the operation of these devices and/or receive feedback from these devices in order to operate in its intended function.

It should also be noted that the water tank 240 of at least one embodiment many sit in a tray connected to a drain in order to capture any leakage or water overflow that might develop.

In yet another embodiment, the system or shower assembly 200 may also include a water reclamation assembly 280 to receive water from the shower drain, represented as 202, filter the water via a water filtration system 282 and pump the filtered reclaimed water back to the tank 240 via reclamation pump 284. Accordingly, the reclamation assembly 280 of at least one embodiment can drastically reduce the water bill as a result of showering and it can facilitate the process of maintaining a desired level of water in the tank 240 at a preset temperature.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention. This written description provides an illustrative explanation and/or account of the present invention. It may be possible to deliver equivalent benefits using variations of the specific embodiments, without departing from the inventive concept. This description and these drawings, therefore, are to be regarded as illustrative and not restrictive.

Now that the invention has been described,

What is claimed is:

1. An automated toilet cleaning system for cleaning a toilet, said automated toilet cleaning system comprising:

at least one cleaning arm assembly movably mounted to a support structure, at least one cleaning apparatus attached to said at least one cleaning arm assembly, at least one positioning assembly, wherein said at least one cleaning arm assembly and said at least one cleaning apparatus are movably disposed relative to the support structure via said at least one positioning assembly, said cleaning arm assembly comprising a biased arm section extendable away from and retractable toward a mounted end of said at least one cleaning arm assembly, and a spacer arm extending from a portion of said at least one cleaning arm assembly, said spacer arm being disposed in contacting relation relative to the toilet, wherein said at least one cleaning apparatus is positionable in a spaced relation from the toilet during at least a portion of a cleaning cycle.

2. The system as recited in claim 1 wherein said at least one cleaning arm assembly is angularly positionable relative to said support structure via said positioning assembly.

3. The system as recited in claim 2 wherein said biased arm is linearly positionable via a biasing force.

4. The system as recited in claim 3 wherein, with said spacer arm in contact with a portion of the toilet, and as said positioning assembly angularly positions said at least one cleaning arm assembly relative to the support structure, said biased arm section is linearly movable to maintain said at least one cleaning apparatus in said spaced relation from the toilet during at least a portion of the cleaning cycle.

5. The system as recited in claim 4 wherein said spacer arm comprises a roller attached to a distal end, said roller being in contact with the toilet during at least a portion of a cleaning cycle.

6. The system as recited in claim 5 further comprising an inner bowl cleaning arm assembly and an inner bowl cleaning apparatus, said inner bowl cleaning apparatus being connected to said inner bowl cleaning arm assembly.

7. The system as recited in claim 6 wherein said inner bowl cleaning arm assembly comprises a positioning assembly to movably position said inner bowl cleaning apparatus into and out of an interior of the toilet.

8. The system as recited in claim 7 wherein said inner bowl cleaning apparatus is movably disposed in a horizontal direction and a vertical direction via said positioning assembly of said inner bowl cleaning arm assembly.

9. The system as recited in claim 8 further comprising a collection plate disposed at least partially below said at least one cleaning arm assembly, said collection plate comprising a recessed collection area fluidically interconnected with a drain pipe to collect and drain fluids dispelled during the cleaning cycle.

10. The system as recited in claim 9 wherein said support structure comprises a frame, said frame comprising at least one base and at least one upper mounting portion, said at least one cleaning arm assembly being movably mounted to said upper mounting portion of said frame via said at least one positioning assembly.

11. The system as recited in claim 10 wherein said base of said frame is fixedly mountable to a floor, wherein said collection plate is disposable in an at least partially overlying relation with said base of said frame.

12. An automated toilet cleaning system for cleaning a toilet, said automated toilet cleaning system comprising:

an inner bowl cleaning arm assembly movably mounted to a frame, a cleaning apparatus attached to said inner bowl cleaning arm assembly, said inner bowl cleaning arm assembly comprising at least one positioning assembly, wherein said inner bowl cleaning arm assembly and said cleaning apparatus are movably disposed relative to the support structure via said at least one positioning assembly, wherein said cleaning apparatus of said inner bowl cleaning arm assembly is disposable into and out of an interior bowl portion of the toilet via said at least one positioning assembly, a collection plate disposed in an at least partially surrounding relation to the toilet, said collection plate comprising a recessed collection area fluidically interconnected with a drain pipe, said frame comprising at least one base mounted to a floor, wherein said collection plate is disposed in at least partially covering relation relative to said base.

13. The system as recited in claim 12 further comprising at least one exterior cleaning arm assembly, said at least one exterior cleaning arm assembly comprising a positioning assembly and at least one exterior cleaning apparatus.

14. The system as recited in claim 13 wherein said at least one exterior cleaning arm assembly comprises a biased arm section linearly extendable away from and retractable toward a mounted end of said at least one exterior cleaning arm assembly.

15. The system as recited in claim 14 further comprising a spacer arm extending from a portion of said at least one exterior cleaning arm assembly, said spacer arm being disposable in a contacting relation with an exterior surface of the toilet, wherein said at least one exterior cleaning apparatus positionable in a spaced relation from the toilet during at least a portion of a cleaning cycle.

16. The system as recited in claim 15 wherein said at least one exterior cleaning arm assembly is angularly positionable relative to said frame via said positioning assembly.

17. The system as recited in claim 16 wherein said biased arm is linearly positionable via a biasing force.

18. The system as recited in claim 17 wherein, with said spacer arm in contact with the exterior surface of the toilet, and as said positioning assembly of said at least one exterior cleaning arm assembly angularly positions said at least one exterior cleaning arm assembly relative to said frame, said biased arm section is linearly movable to maintain said at least one exterior cleaning apparatus in said spaced relation from the toilet during at least a portion of the cleaning cycle.

* * * * *